US011085137B2

(12) United States Patent
Salvi et al.

(10) Patent No.: US 11,085,137 B2
(45) Date of Patent: Aug. 10, 2021

(54) SYSTEM AND METHOD FOR LOWERING HUMIDITY WITHIN A WASHING MACHINE APPLIANCE

(71) Applicant: Haier US Appliance Solutions, Inc., Wilmington, DE (US)

(72) Inventors: Rushikesh Salvi, Louisville, KY (US); Kenneth G. Rudolph, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 66 days.

(21) Appl. No.: 16/677,762

(22) Filed: Nov. 8, 2019

(65) Prior Publication Data

US 2021/0140086 A1 May 13, 2021

(51) Int. Cl.

| | |
|---|---|
| ***D06F 17/12*** | (2006.01) |
| ***D06F 37/30*** | (2020.01) |
| ***D06F 23/02*** | (2006.01) |
| ***D06F 33/00*** | (2020.01) |

(52) U.S. Cl.

CPC ..... *D06F 17/12* (2013.01); *D06F 23/02* (2013.01); *D06F 33/00* (2013.01); *D06F 37/304* (2013.01)

(58) Field of Classification Search

CPC ..... D06F 17/12

See application file for complete search history.

(56) References Cited

U.S. PATENT DOCUMENTS

| | | | |
|---|---|---|---|
| 6,000,248 | A | 12/1999 | Erickson et al. |
| 8,984,692 | B2 | 3/2015 | Balinski et al. |
| 2013/0192084 | A1 | 8/2013 | Hill et al. |

FOREIGN PATENT DOCUMENTS

| | | | |
|---|---|---|---|
| EP | 3095910 | B1 | 12/2017 |

*Primary Examiner* — Jason Y Ko

(74) *Attorney, Agent, or Firm* — Dority & Manning, P.A.

(57) ABSTRACT

A washing machine appliance includes a wash tub defining a wash chamber and an intake and exhaust duct that are fluidly coupled to the wash chamber. A vent door is positioned within the intake duct for regulating a flow of air into the wash chamber and a drive motor selectively rotates a wash basket within the wash tub. When a command to reduce humidity is received, a controller may open the vent door and rotate the wash basket in a periodic cycle to urge the flow of air through the wash chamber and out the exhaust duct to lower a humidity within the wash chamber and the gasket, e.g., to reduce mold and mildew growth.

20 Claims, 7 Drawing Sheets

SYSTEM AND METHOD FOR LOWERING HUMIDITY WITHIN A WASHING MACHINE APPLIANCE

FIELD OF THE INVENTION

The present subject matter relates generally to washing machine appliances, or more specifically, to systems and methods for reducing humidity and moisture within a washing machine appliance.

BACKGROUND OF THE INVENTION

Washing machine appliances generally include a tub for containing water or wash fluid, e.g., water and detergent, bleach, and/or other wash additives. A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc. During a spin or drain cycle, a drain pump assembly may operate to discharge water from within sump.

Notably, when the wash or rinse cycle is completed, excess wash fluid commonly collects in a bottom of the tub, within the door gasket, etc. Because the wash tub is partially or substantially sealed, this wash fluid remains in the tub until the next wash or rinse cycle and the humidity remains relatively constant between cycles. Such collected wash fluid, excessive humidity, and moisture may result in mold, mildew, or foul smells. Notably, conventional washing machine appliances have no way to reduce such moisture collection or mitigate that effects of such moisture. For example, users typically must leave the door open after every cycle, which can be burdensome and can be relatively ineffective at evaporating collected wash fluid.

Accordingly, a washing machine appliance having improved features for reducing moisture and humidity would be desirable. More specifically, a washing machine appliance with an improved system and method for reducing the humidity and minimizing mold and mildew in the wash tub would be particularly beneficial.

BRIEF DESCRIPTION OF THE INVENTION

Advantages of the invention will be set forth in part in the following description, or may be apparent from the description, or may be learned through practice of the invention.

In accordance with one exemplary embodiment of the present disclosure, a washing machine appliance is provided including a wash tub positioned within a cabinet and defining a wash chamber, a wash basket rotatably mounted within the wash tub and being configured for receiving of a load of articles for washing, and a drive motor operably coupled to the wash basket for selectively rotating the wash basket. An intake duct provides fluid communication between an ambient environment and the wash chamber for providing a flow of fresh air into the wash chamber, an exhaust duct provides fluid communication between the wash chamber and the ambient environment for discharging the flow of air from the wash chamber, and a vent door is operably coupled to at least one of the intake duct or the exhaust duct for regulating the flow of air. A controller is operably coupled to the drive motor and the vent door, and is configured for receiving a command to lower a humidity within the wash chamber, opening the vent door, and selectively operating the drive motor to rotate the wash basket and urge the flow of air through the wash chamber.

In accordance with another exemplary embodiment of the present disclosure, a method of lowering a humidity within a washing machine appliance is provided. The washing machine appliance includes a wash basket rotatably mounted within a wash tub, an intake duct fluidly coupled to the wash chamber, and an exhaust duct fluidly coupled to the wash chamber. The method includes receiving a command to lower the humidity within the wash chamber, opening a vent door operably coupled to the intake duct to permit a flow of air into the wash chamber, and selectively operating a drive motor to rotate the wash basket and urge the flow of air through the wash chamber and out of the exhaust duct.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
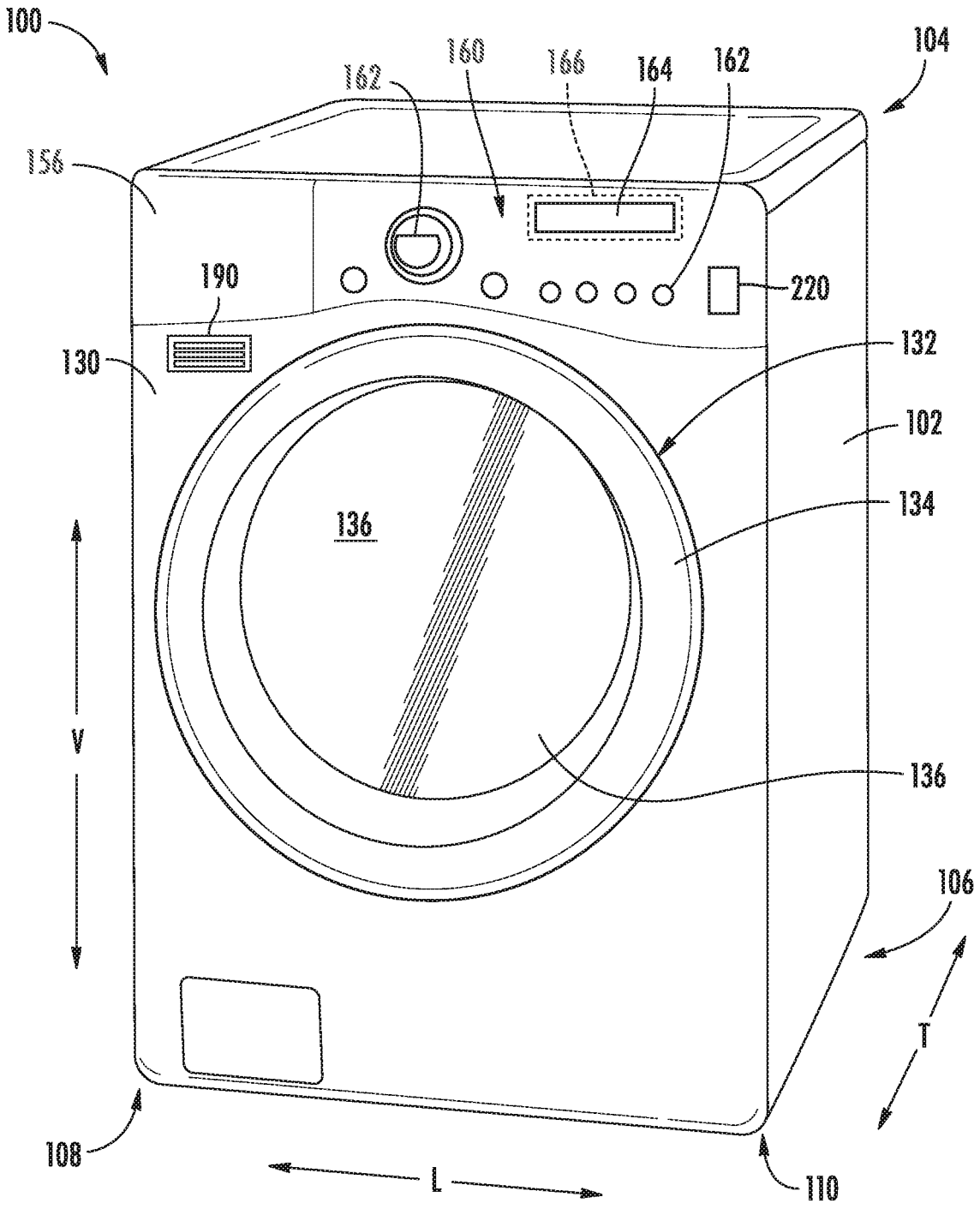
FIG. 1 provides a perspective view of an exemplary washing machine appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
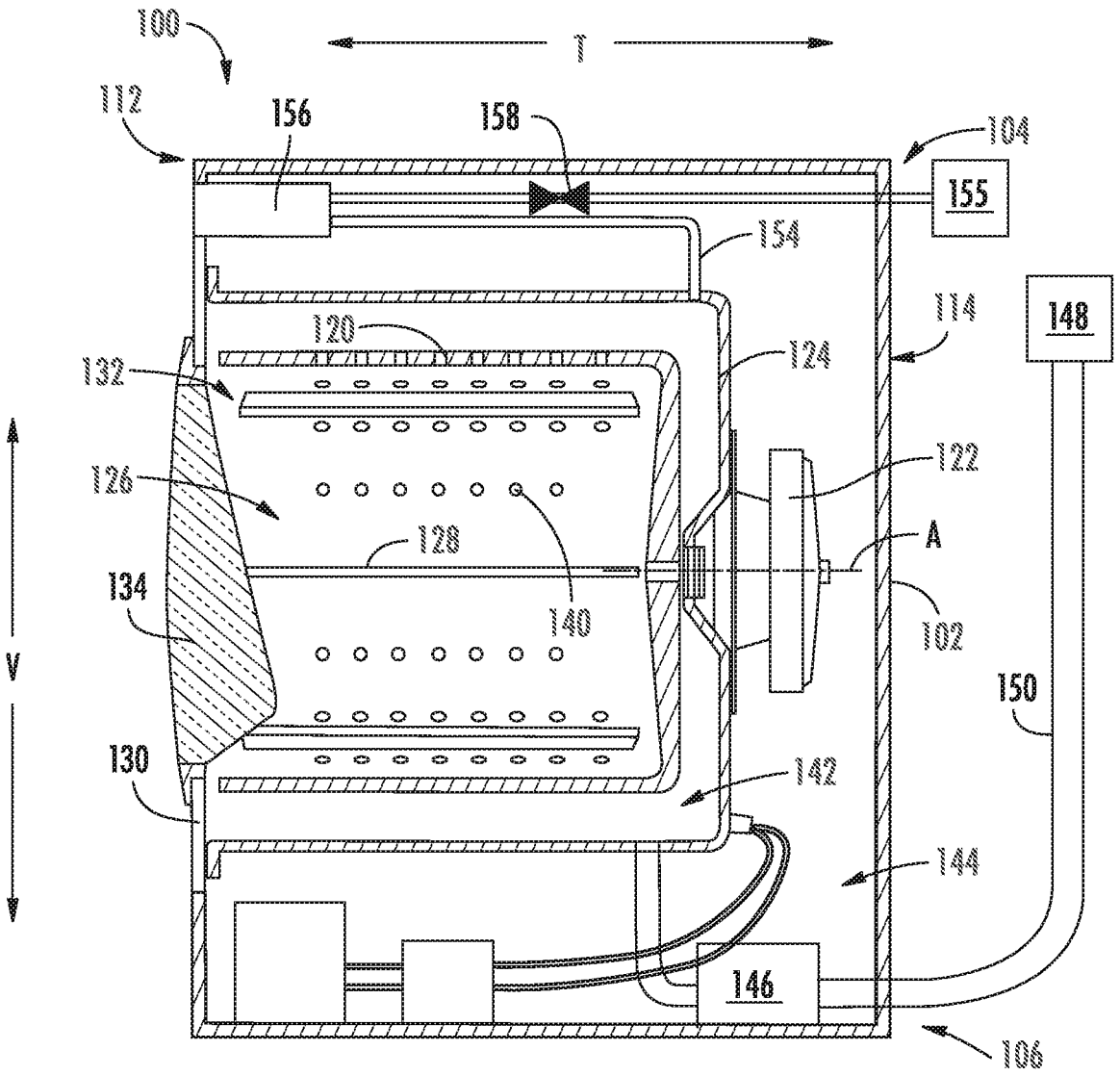
FIG. 2 provides a side cross-sectional view of the exemplary washing machine appliance of FIG. 1.

Referring now to the figures, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction, and between a front 112 and a rear 114 along the transverse direction T.

Referring to FIG. 2, a wash basket 120 is rotatably mounted within cabinet 102 such that it is rotatable about an axis of rotation A. A motor 122, e.g., such as a pancake motor, is in mechanical communication with wash basket 120 to selectively rotate wash basket 120 (e.g., during an agitation or a rinse cycle of washing machine appliance 100). Wash basket 120 is received within a wash tub 124 and defines a wash chamber 126 that is configured for receipt of articles for washing. The wash tub 124 holds wash and rinse fluids for agitation in wash basket 120 within wash tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Wash basket 120 may define one or more agitator features that extend into wash chamber 126 to assist in agitation and cleaning articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in wash basket 120 during rotation of wash basket 120.

Referring generally to FIGS. 1 and 2, cabinet 102 also includes a front panel 130 which defines an opening 132 that permits user access to wash basket 120 of wash tub 124. More specifically, washing machine appliance 100 includes a door 134 that is positioned over opening 132 and is rotatably mounted to front panel 130. In this manner, door 134 permits selective access to opening 132 by being movable between an open position (not shown) facilitating access to a wash tub 124 and a closed position (FIG. 1) prohibiting access to wash tub 124.

A window 136 in door 134 permits viewing of wash basket 120 when door 134 is in the closed position, e.g., during operation of washing machine appliance 100. Door 134 also includes a handle (not shown) that, e.g., a user may pull when opening and closing door 134. Further, although door 134 is illustrated as mounted to front panel 130, it should be appreciated that door 134 may be mounted to another side of cabinet 102 or any other suitable support according to alternative embodiments.

Referring again to FIG. 2, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of and generally collects wash fluid during operation of washing machine appliance 100. For example, during operation of washing machine appliance 100, wash fluid may be urged by gravity from basket 120 to sump 142 through plurality of perforations 140.

A drain pump assembly 144 is located beneath wash tub 124 and is in fluid communication with sump 142 for periodically discharging soiled wash fluid from washing machine appliance 100. Drain pump assembly 144 may generally include a drain pump 146 which is in fluid communication with sump 142 and with an external drain 148 through a drain hose 150. During a drain cycle, drain pump 146 urges a flow of wash fluid from sump 142, through drain hose 150, and to external drain 148. More specifically, drain pump 146 includes a motor (not shown) which is energized during a drain cycle such that drain pump 146 draws wash fluid from sump 142 and urges it through drain hose 150 to external drain 148.

A spout 154 is configured for directing a flow of fluid into wash tub 124. For example, spout 154 may be in fluid communication with a water supply 155 (FIG. 2) in order to direct fluid (e.g., clean water or wash fluid) into wash tub 124. Spout 154 may also be in fluid communication with the sump 142. For example, pump assembly 144 may direct wash fluid disposed in sump 142 to spout 154 in order to circulate wash fluid in wash tub 124.

As illustrated in FIG. 2, a detergent drawer 156 is slidably mounted within front panel 130. Detergent drawer 156 receives a wash additive (e.g., detergent, fabric softener, bleach, or any other suitable liquid or powder) and directs the fluid additive to wash chamber 124 during operation of washing machine appliance 100. According to the illustrated embodiment, detergent drawer 156 may also be fluidly coupled to spout 154 to facilitate the complete and accurate dispensing of wash additive.

In addition, a water supply valve or control valve 158 may provide a flow of water from a water supply source (such as a municipal water supply 155) into detergent dispenser 156 and into wash tub 124. In this manner, control valve 158 may generally be operable to supply water into detergent dispenser 156 to generate a wash fluid, e.g., for use in a wash cycle, or a flow of fresh water, e.g., for a rinse cycle. It should be appreciated that control valve 158 may be positioned at any other suitable location within cabinet 102. In addition, although control valve 158 is described herein as regulating the flow of "wash fluid," it should be appreciated that this term includes, water, detergent, other additives, or some mixture thereof.

A control panel 160 including a plurality of input selectors 162 is coupled to front panel 130. Control panel 160 and input selectors 162 collectively form a user interface input for operator selection of machine cycles and features. For example, in one embodiment, a display 164 indicates selected features, a countdown timer, and/or other items of interest to machine users.

Operation of washing machine appliance 100 is controlled by a controller or processing device 166 (FIG. 1) that is operatively coupled to control panel 160 for user manipulation to select washing machine cycles and features. In response to user manipulation of control panel 160, controller 166 operates the various components of washing machine appliance 100 to execute selected machine cycles and features.

Controller 166 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 160 and other components of washing machine appliance 100 may be in communication with controller 166 via one or more signal lines or shared communication busses.

During operation of washing machine appliance 100, laundry items are loaded into wash basket 120 through opening 132, and washing operation is initiated through operator manipulation of input selectors 162. Wash tub 124 is filled with water, detergent, and/or other fluid additives, e.g., via spout 154 and or detergent drawer 156. One or more valves (e.g., control valve 158) can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with ribs 128) for washing of laundry items in wash basket 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle and/or after the rinse cycle in order to wring wash fluid from the articles being washed. During a final spin cycle, basket 120 is rotated at relatively high speeds and drain pump assembly 144 may discharge wash fluid from sump 142. After articles disposed in wash basket 120 are cleaned, washed, and/or rinsed, the user can remove the articles from wash basket 120, e.g., by opening door 134 and reaching into wash basket 120 through opening 132.

While described in the context of a specific embodiment of horizontal axis washing machine appliance 100, using the teachings disclosed herein it will be understood that horizontal axis washing machine appliance 100 is provided by way of example only. Other washing machine appliances having different configurations, different appearances, and/or different features may also be utilized with the present subject matter as well, e.g., vertical axis washing machine appliances.

Referring now generally to FIGS. 3 through 6, a washing machine appliance and a humidity reduction system 170 will be described according to an exemplary embodiment of the present subject matter. Due to the similarity between the washing machine appliance illustrated in FIG. 3 and washing machine appliance 100, like reference numerals may be used to refer to the same or similar features. As explained briefly above, washing machine appliance 100 may have a tendency to collect excess liquid or moisture within particular locations where mold, mildew, and foul smells may be generated. Aspects of the present subject matter are directed to features for reducing the humidity and moisture within washing machine appliance 100, thereby reducing the likelihood of such moisture related issues.

Specifically, humidity reduction system 170 may be operably coupled to a dedicated controller or appliance controller 166 for selectively reducing humidity within washing machine appliance 100. In this regard, humidity reduction system 170 includes an intake duct 172 that provides fluid communication between an ambient environment 174 and wash chamber 126 for providing a flow of air, e.g., as indicated by reference numeral 176 in FIG. 3. In addition, humidity reduction system 170 includes an exhaust duct 178 that provides fluid communication between wash chamber 126 and ambient environment 174 for discharging the flow of air 176 from wash chamber 126. Although one exemplary construction, positioning, and configuration of humidity reduction system 170 is described herein, it should be appreciated that variations and modifications may be made to humidity reduction system 170 while remaining within the scope of the present subject matter.

According to the illustrated embodiment, intake duct 172 extends from an intake inlet 190 positioned at front 112 of cabinet 102 to an intake outlet 192. Thus, the flow of air 176 from ambient environment 174, e.g., from outside of cabinet 102, may be drawn into intake duct 172 through intake inlet 190. The flow of air 176 may then pass into wash chamber 126 through intake outlet 192. Specifically, washing machine appliance 100 may include a door gasket 194 that is positioned between wash tub 124 and door 134, e.g., to provide a fluid seal therebetween. Notably, door gasket 194 frequently has crevices or creases that tend to collect wash fluid or retain excess moisture. Thus, according to the illustrated embodiment, intake outlet 192 is defined on door gasket 194, e.g., proximate a top of door gasket 194. Thus, the flow of air 176 passes directly into door gasket 194, circulates through door gasket 194, and passes into wash chamber 126 before exiting washing machine appliance 100 through exhaust duct 178. Specifically, exhaust duct 178 defines an exhaust inlet 196 and an exhaust outlet 198. According to the illustrated embodiment, exhaust inlet 196 is defined on wash tub 124 and exhaust outlet 198 is defined in a rear 114 of cabinet 102.

Figure 4:
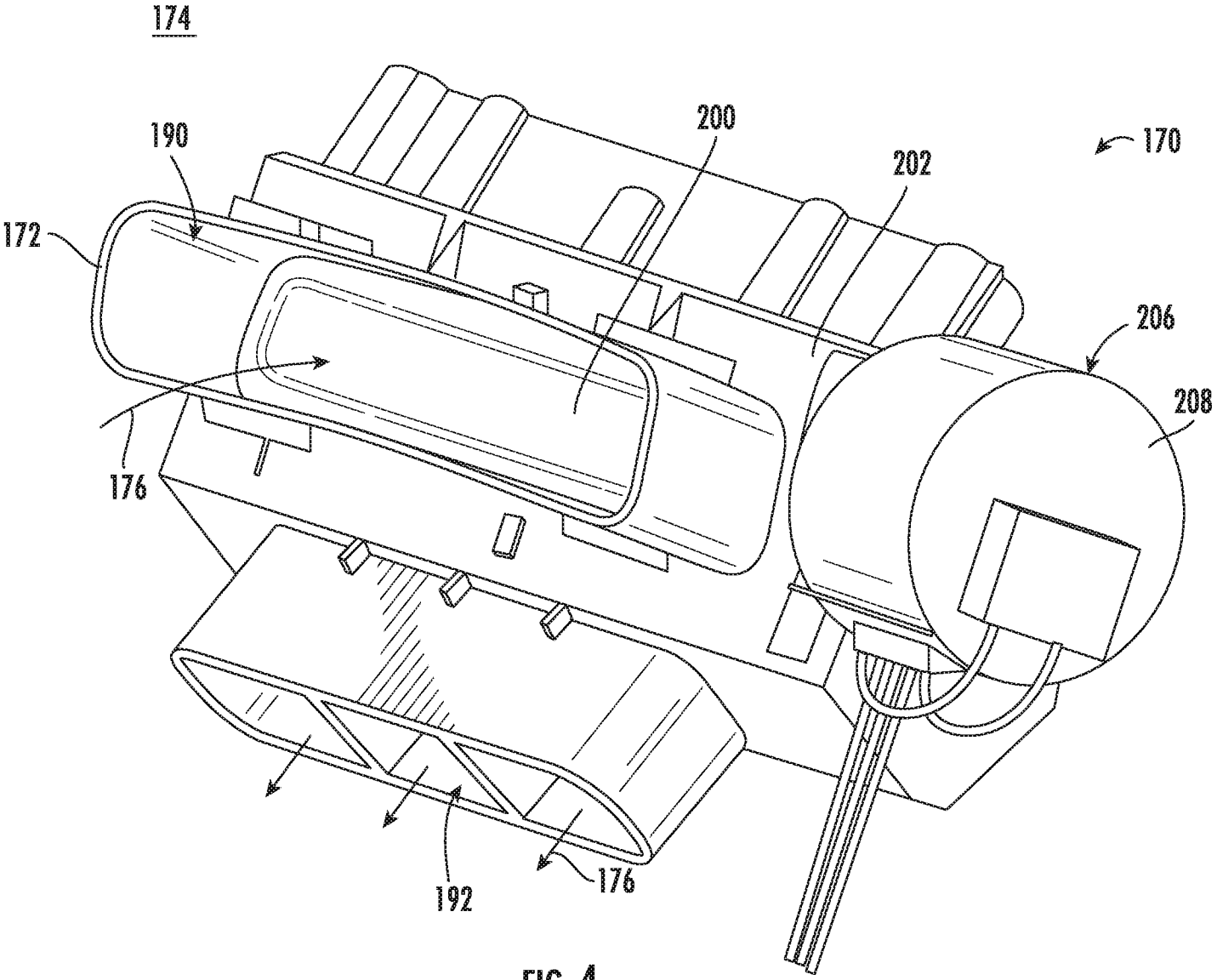
FIG. 4 is a perspective view of a damper assembly for use with the exemplary washing machine appliance of FIG. 3 according to an exemplary embodiment of the present subject matter.
Figure 5:
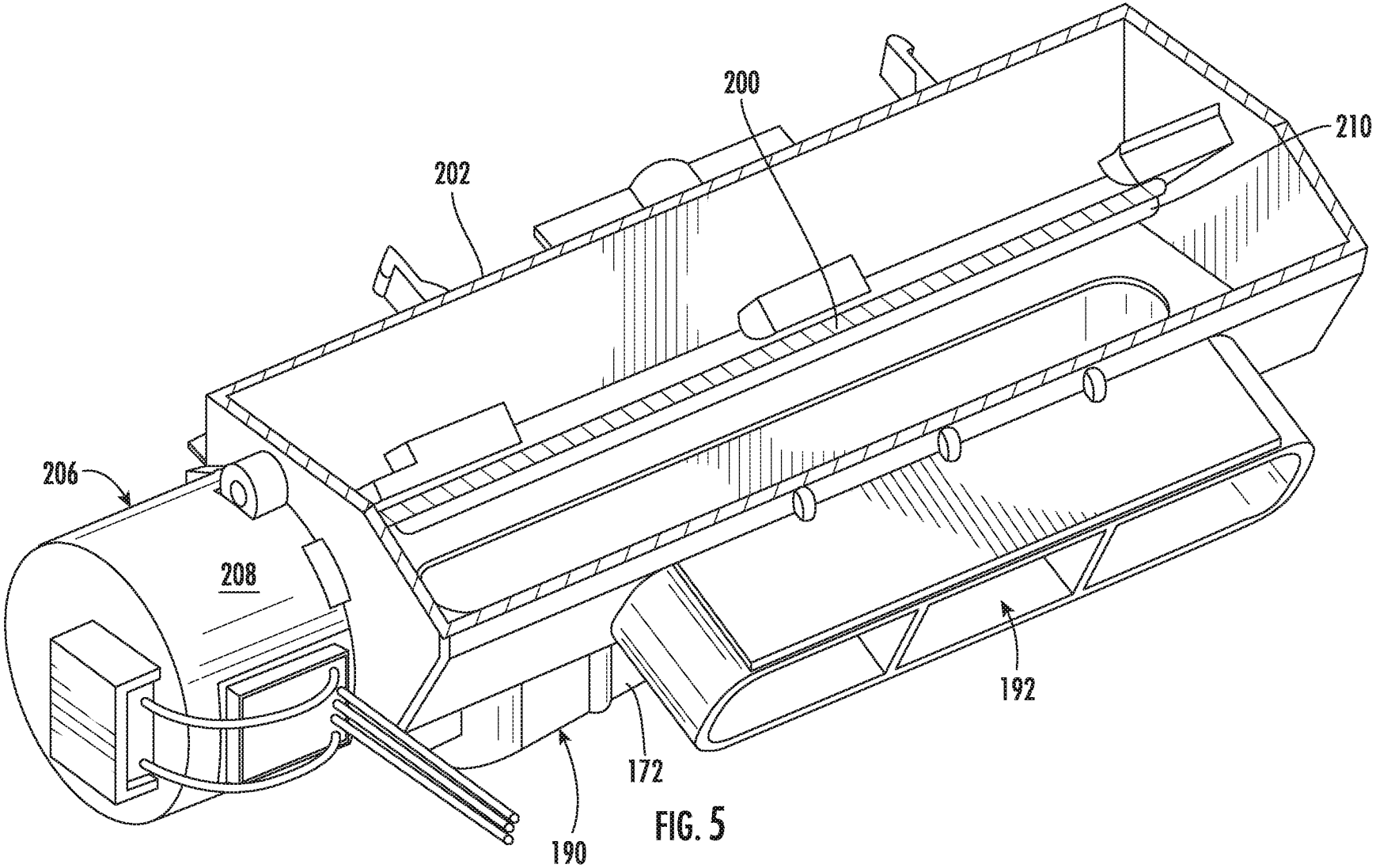
FIG. 5 is a cross sectional view of the exemplary damper assembly of FIG. 4 according to an exemplary embodiment of the present subject matter.
Figure 6:
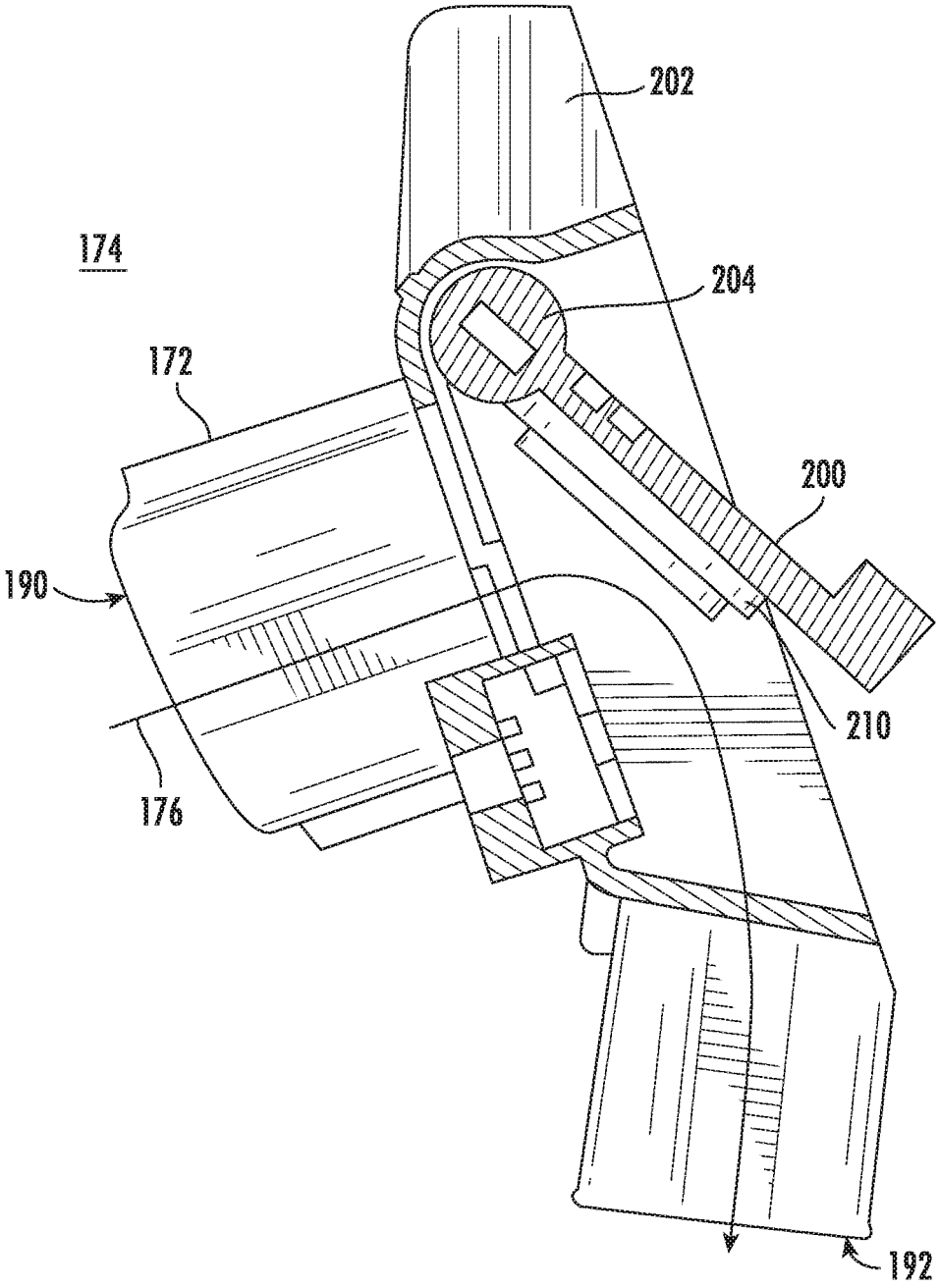
FIG. 6 is a cross sectional view of the exemplary damper assembly of FIG. 4 according to an exemplary embodiment of the present subject matter.

Notably, for reasons described in more detail below, it may be frequently desirable to stop the flow of air 176 passing through intake duct 172 and exhaust duct 178 of humidity reduction system 170. Therefore, according to exemplary embodiments of the present subject matter, humidity reduction system 170 further includes a vent door 200 or another suitable damper system configured for selectively restricting or stopping the flow of air 176. In this regard, as best shown in FIGS. 4 through 6, vent door 200 may be positioned within a damper housing 202 that is fluidly coupled to, or forms a part of, intake duct 172. Specifically, vent door 200 may be pivotally mounted at a hinge 204 and may be movable between a closed position (not shown) in an open position (e.g., as shown in FIG. 6). According to the illustrated embodiment, vent door 200 is operably coupled to intake duct 172. However, it should be appreciated that according to alternative embodiments, vent door 200 could be positioned on exhaust duct 178 or at any other suitable location within humidity reduction system 170.

As best shown in FIGS. 4 and 5, vent door 200 may be operably coupled with a vent door actuator 206 for moving vent door 200 between the open position and the closed position. For example, according to the illustrated embodiment, the door actuator 206 is a stepper motor 208 that may selectively position vent door 200 and the fully closed position, the fully open position, or any other suitable positioning therebetween. According to alternative embodiments, vent door actuator 206 may be a hydraulic actuator, an electromagnetic actuator, or any other suitable device for changing the position of vent door 200. Vent door 200 may further include a resilient seal 210, e.g., for forming an airtight seal when vent door 200 is closed.

As will be described in more detail below, controller 166 of washing machine appliance 100 may be operably coupled with both stepper motor 208 of door 200 and with motor 122 for rotating wash basket 120. Thus, at desired times, controller 166 may implement a humidity reduction cycle using humidity reduction system 170. For example, such a cycle may include opening vent door 200 and selectively rotating wash basket 120 to urge the flow of air 176 through door gasket 194 and wash chamber 126.

Figure 3:
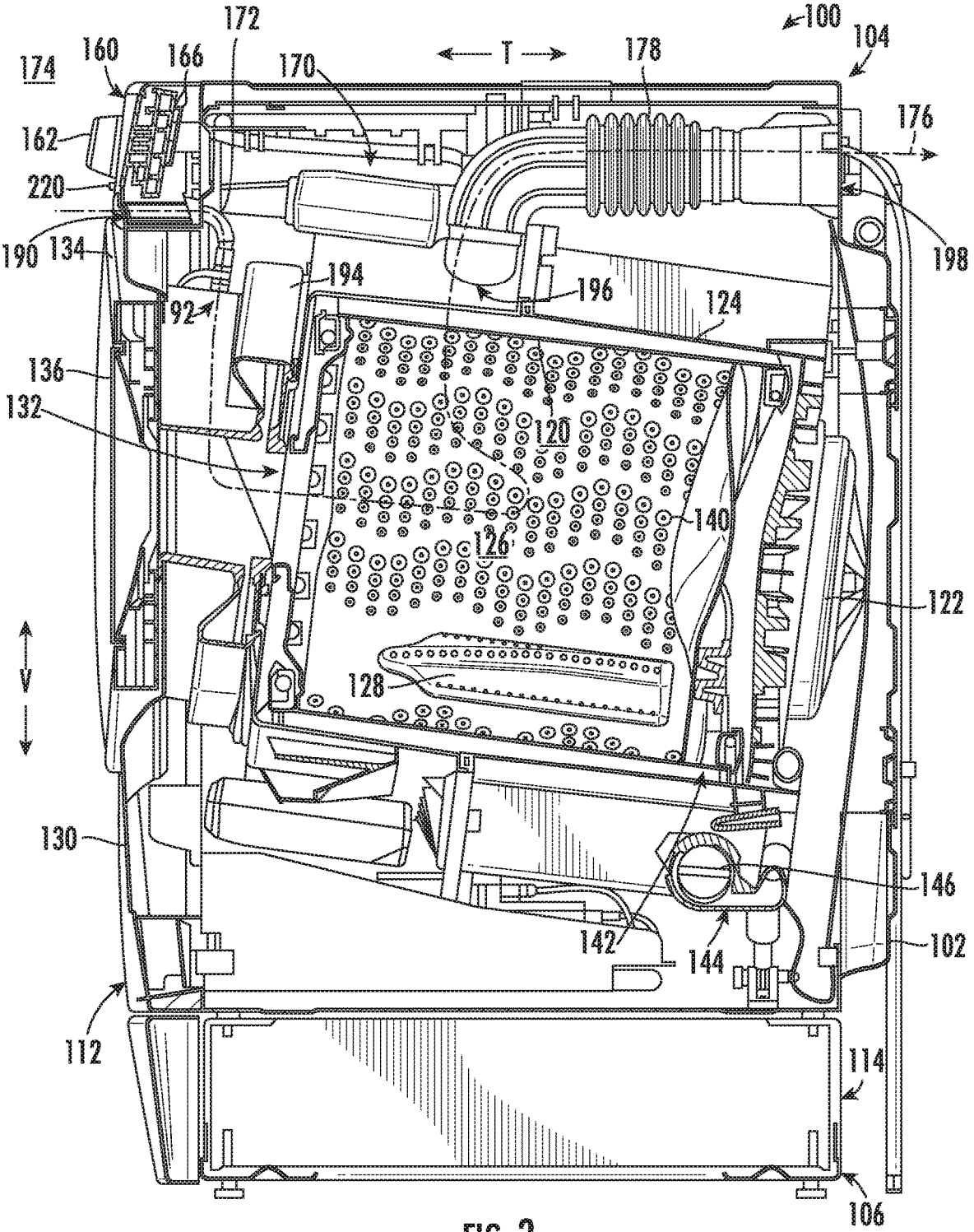
FIG. 3 provides a side cross-sectional view of the exemplary washing machine appliance of FIG. 1.

Notably, according to an exemplary embodiment, a humidity reduction cycle may be performed following every wash or rinse cycle. According to still another embodiment, washing machine appliance 100 may include one or more humidity sensors that detect the humidity within wash chamber 126 and initiate a humidity reduction cycle when humidity levels reach or remain at a unsuitable humidity level. In addition, as best illustrated in FIG. 3, washing machine appliance 100 may further include a vent button 220 which may be used to initiate a humidity reduction cycle. In this regard, a user may periodically push vent button 220, which is operably coupled with controller 166, to initiate a humidity reduction cycle.

Now that the construction of washing machine appliance 100 and the configuration of controller 166 according to exemplary embodiments have been presented, an exemplary method 300 of operating a washing machine appliance will be described. Although the discussion below refers to the exemplary method 300 of operating washing machine appliance 100, one skilled in the art will appreciate that the exemplary method 300 is applicable to the operation of a variety of other washing machine appliances, such as vertical axis washing machine appliances. In exemplary embodiments, the various method steps as disclosed herein may be performed by controller 166 or a separate, dedicated controller.

Figure 7:
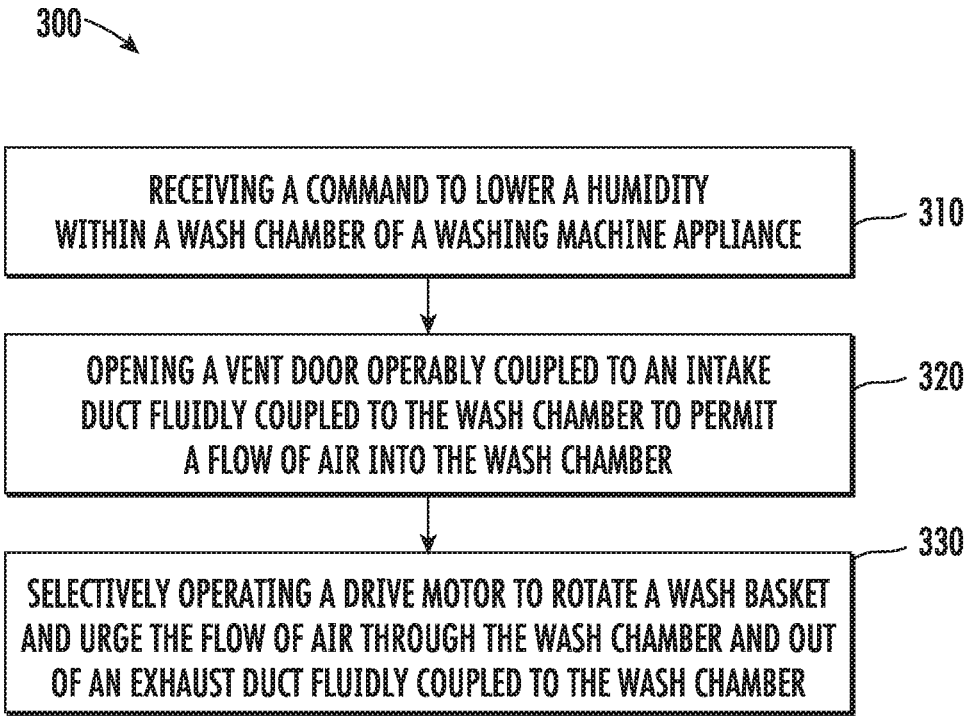
FIG. 7 illustrates a method for lowering a humidity in a washing machine appliance in accordance with one embodiment of the present disclosure.

Referring now to FIG. 7, method 300 includes, at step 310, receiving a command to lower a humidity within a wash chamber of a washing machine appliance. For example, continuing example from above, when a user presses vent button 220, controller 166 may initiate a humidity reduction cycle using humidity reduction system 170. Such a humidity reduction cycle may be initiated automatically or based on a user input, e.g., such as via vent button 220. The humidity reduction cycle is generally configured for reducing a humidity or moisture within door gasket 194 and wash chamber 126, e.g., to prevent the formation of mold, mildew, or stale smells.

Specifically, step 320 may include opening a vent door operably coupled to an intake duct fluidly coupled to the wash chamber to permit a flow of air into the wash chamber. Step 330 includes selectively operating a drive motor to rotate a wash basket and urge the flow of air through the wash chamber and out of an exhaust duct fluidly coupled to the wash chamber. For example, when the humidity reduction cycle is initiated, controller 166 may selectively open vent door 200 and selectively rotate wash basket 120 to urge the flow of air 176 into door gasket 194 and wash chamber 126 through intake duct 172 and out of wash chamber 126 through exhaust duct 178, thereby discharging air with relatively high humidity. Notably, a spin speed of wash basket 120 and the on/off cycles of wash basket may greatly affect the effectiveness of the humidity reduction system 170 in lowering the humidity within wash chamber 126 and door gasket 194.

For example, according to an exemplary embodiment, selectively operating the drive motor to rotate the wash basket includes rotating the wash basket in a repeated, periodic cycle for a total drying time to reduce moisture or humidity below a desired threshold. In this regard, the periodic cycle may include a fixed spin time within a fixed time period. For example, the periodic cycle may repeat every 30 minutes or every hour and the fixed spin time may be five minutes, 10 minutes, 20 minutes, or 30 minutes. In other words, wash basket 120 may be rotated for five minutes out of every 30 minutes, for 10 minutes out of every 30 minutes, for 15 minutes of every 30 minutes, for 10 minutes out of every hour, for 20 minutes out of every hour, for 30 minutes out of every hour, or in any other suitable on/off cycle for reducing humidity or excess moisture. In addition, this periodic cycle may be repeated as long as necessary to reduce humidity within wash chamber 126 below a predetermined threshold amount. For example, empirical data may show that the periodic cycle should be repeated for a total drying time of six hours, eight hours, 10 hours, or longer.

In general, wash basket 120 may be rotated at any suitable speed during a humidity reduction cycle. For example, according to the illustrated embodiment, wash basket 120 is rotated at a spin speed of between about 100 and 125 revolutions per minute (RPM). However, according to alternative embodiments, the spin speed of wash basket 120 may be between about 20 and 200 RPM, between about 50 and 170 RPM, between about 70 and 160 RPM, between about 90 and 150 RPM, or any other suitable speed range. It should be appreciated that the periodic cycle time, the total drying time, the spin speeds, and the vent door position may vary significantly while remaining within the scope of the present subject matter. For example, these parameters of humidity reduction system 170 may vary based on the motor spin speed, chamber volume, ambient conditions, and other factors.

FIG. 7 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 300 are explained using washing machine appliance 100 as an example, it should be appreciated that these methods may be applied to the operation of any suitable washing machine appliance.

This system and method described above for reducing humidity and moisture within a washing machine appliance provides a cost-effective and efficient method for reducing excess moisture, mold growth, mildew, and foul smells within the washing machine appliance. The periodic humidity reduction cycle is configured for periodically discharging humid air while also periodically pausing to allow fresh, relatively dry air to become humidified. In this regard, the air is forced out of wash chamber 126 and door gasket 194 as the basket spins, such that saturated water vapors are expelled out of washing machine appliance 100 through exhaust duct 178. However, the rate of evaporation may be limited by the difference between the saturated water vapor density at the surface temperature and the ambient water vapor density which is washer water vapor density. Thus, forced convection from a continuous basket spin cycle may be relatively limited. However, the off times in the periodic spin cycle may be effective for allowing the fresh air to become humidified by moisture within the wash chamber before being discharged.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a wash tub positioned within a cabinet and defining a wash chamber;

a wash basket rotatably mounted within the wash tub and being configured for receiving of a load of articles for washing;

a drive motor operably coupled to the wash basket for selectively rotating the wash basket;

an intake duct providing fluid communication between an ambient environment and the wash chamber for providing a flow of fresh air into the wash chamber;

an exhaust duct providing fluid communication between the wash chamber and the ambient environment for discharging the flow of air from the wash chamber;

a vent door operably coupled to at least one of the intake duct or the exhaust duct for regulating the flow of air; and a controller operably coupled to the drive motor and the vent door, the controller being configured for:

receiving a command to lower a humidity within the wash chamber;

opening the vent door; and selectively operating the drive motor to rotate the wash basket and urge the flow of air through the wash chamber.

2. The washing machine appliance of claim 1, wherein selectively operating the drive motor to rotate the wash basket comprises:

rotating the wash basket in a periodic cycle for a total drying time.

3. The washing machine appliance of claim 2, wherein the period cycle comprises a fixed spin time during a fixed time period.

4. The washing machine appliance of claim 3, wherein the fixed spin time is approximately 10 minutes and the fixed time period is approximately 30 minutes.

5. The washing machine appliance of claim 2, wherein the total drying time is between about 6 and 10 hours.

6. The washing machine appliance of claim 1, wherein selectively operating the drive motor to rotate the wash basket comprises:

rotating the wash basket at a spin speed of between about 100 and 125 revolutions per minute.

7. The washing machine appliance of claim 1, further comprising:

a gasket positioned between the cabinet and a door frame of a door of the washing machine appliance, wherein the intake duct is fluidly coupled to the gasket for directing the flow of air directly through the gasket.

8. The washing machine appliance of claim 1, wherein intake duct defines an intake inlet positioned proximate a front of the cabinet.

9. The washing machine appliance of claim 1, wherein exhaust duct defines an exhaust outlet positioned proximate a rear of the cabinet.

10. The washing machine appliance of claim 1, wherein the vent door is mounted within the intake duct for regulating the flow of air passing through the intake duct.

11. The washing machine appliance of claim 1, further comprising:

a vent door actuator operably coupled with the vent door for moving the vent door between an open position and a closed position.

12. The washing machine appliance of claim 11, wherein the vent door actuator is a stepper motor.

13. The washing machine appliance of claim 1, further comprising:

a vent button in operative communication with a controller, wherein the command to lower the humidity is received when a user presses the vent button.

14. The washing machine appliance of claim 1, wherein the wash tub is a horizontal axis washing machine.

15. A method of lowering a humidity within a washing machine appliance, the washing machine appliance comprising a wash basket rotatably mounted within a wash tub, an intake duct fluidly coupled to the wash chamber, and an exhaust duct fluidly coupled to the wash chamber, the method comprising:

receiving a command to lower the humidity within the wash chamber;

opening a vent door operably coupled to the intake duct to permit a flow of air into the wash chamber; and selectively operating a drive motor to rotate the wash basket and urge the flow of air through the wash chamber and out of the exhaust duct.

16. The method of claim 15, wherein selectively operating the drive motor to rotate the wash basket comprises:

rotating the wash basket in a periodic cycle for a total drying time.

17. The method of claim 16, wherein the period cycle comprises a fixed spin time during a fixed time period.

18. The method of claim 17, wherein the fixed spin time is approximately 10 minutes, the fixed time period is approximately 30 minutes, and the total drying time is between about 6 and 10 hours.

19. The method of claim 15, wherein selectively operating the drive motor to rotate the wash basket comprises:

rotating the wash basket at a spin speed of between about 100 and 125 revolutions per minute.

20. The method of claim 15, wherein the command to lower the humidity is received when a user presses a vent button.

* * * * *